United States Patent [19]

Schmidt

[11] Patent Number: 4,747,695

[45] Date of Patent: May 31, 1988

[54] CENTRIFUGAL STIRRING APPARATUS

[75] Inventor: Paul Schmidt, Essen, Fed. Rep. of Germany

[73] Assignee: Dr. - ING. Manfrid Dreher GmbH & Co. KG, Fed. Rep. of Germany

[21] Appl. No.: 26,175

[22] Filed: Mar. 16, 1987

Related U.S. Application Data

[63] Continuation of Ser. No. 757,357, Jul. 22, 1985, abandoned.

[30] Foreign Application Priority Data

Jul. 26, 1984 [DE] Fed. Rep. of Germany ..... 3427568

[51] Int. Cl.[4] ..... B01F 7/26; B24B 19/00

[52] U.S. Cl. ..... 366/291; 51/7; 51/163.1; 241/46.17; 241/101 B; 366/15; 366/91; 366/297; 366/315

[58] Field of Search ..... 366/14, 15, 91, 241, 366/262–265, 279, 290, 291, 292, 297, 315, 342, 343, 349; 241/101 B, 46.02, 46.17, 97, 284; 29/DIG. 19; 51/16, 24, 25, 7, 163.1, 163.2, 164.1, 164.2

[56] References Cited

U.S. PATENT DOCUMENTS 1,358,251 11/1920 Schaum .
1,605,596 11/1926 Langelier .
2,845,936 8/1958 Boynton et al. .
3,054,230 9/1962 Logue .
4,084,355 4/1978 Balz .
4,385,472 5/1983 Balz .

FOREIGN PATENT DOCUMENTS 3320891 6/1983 Fed. Rep. of Germany .
2050199 8/1971 France .

OTHER PUBLICATIONS

Chemetall, Image and Service.
Chemetall, Turbomatic 200, Turbomatic 400.
Chemetall, Turbomatic 50, Turbomatic 200, Turbomatic 400.
Chemetall, Turbomatic 400.
Rösler, Keramo-Finish.
Trowal,-Maschinen, Verfahrensmittel, & Abwassertechnik.
Rösler—30 Jahre Gleitschlifftechnik.
Turbopol, Tipo SCA 150.
Turbopol, Tipo SC.
Osro, Osronaut.
Trowal, Kompass.

*Primary Examiner*—Timothy F. Simone
*Attorney, Agent, or Firm*—Leydig, Voit & Mayer

[57] ABSTRACT

A centrifugal stirring apparatus for treating loose particles or workpieces, comprising a work vessel and a rotary stirring disc on the floor of the work vessel, is characterized in that at least two work vessels comprising stirring discs are arranged adjacent one another and connected with one another via a common overflow opening. The particles or workpieces to be treated may pass directly from one work vessel to the next through such overflow openings and finally exit from the last vessel.

16 Claims, 2 Drawing Sheets

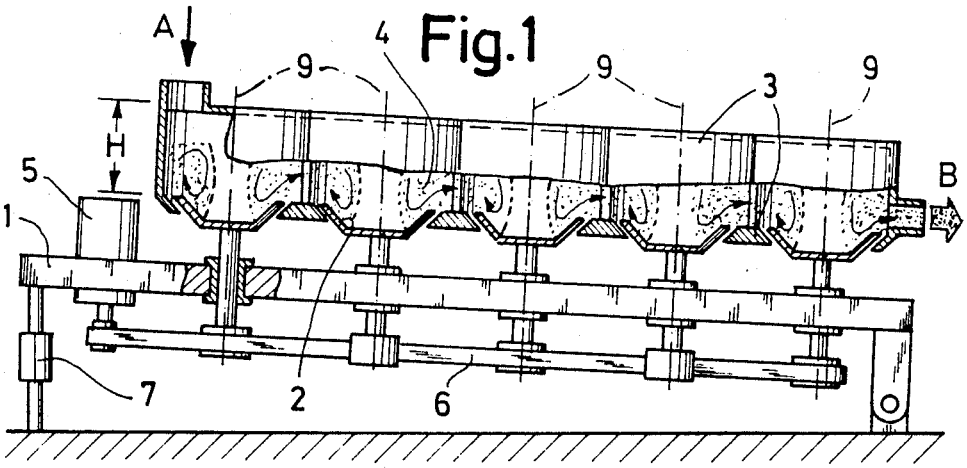
Fig.1
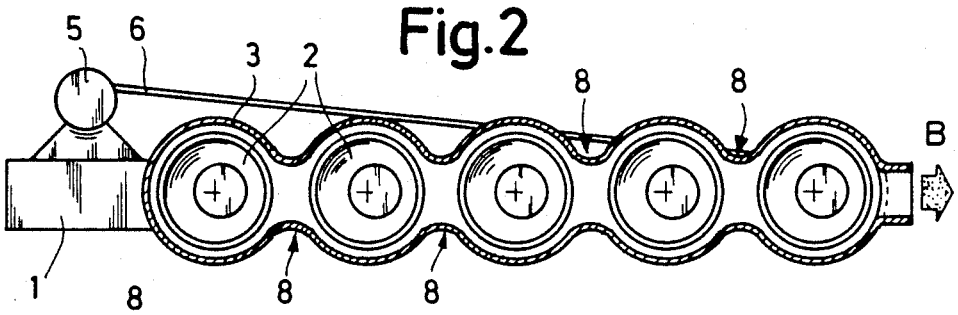
Fig.2
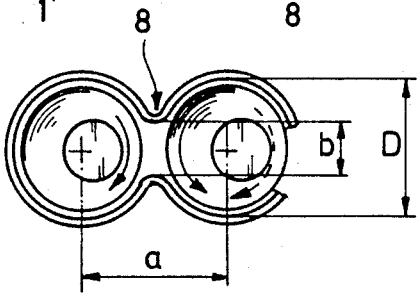
Fig.3
Fig.4
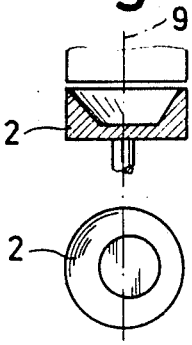
Fig.5
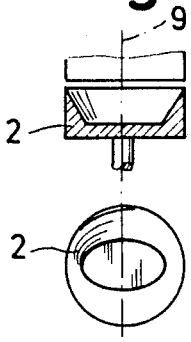
Fig.6
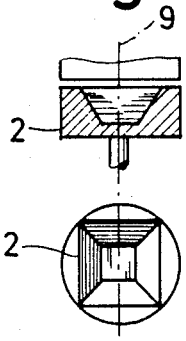
Fig.7
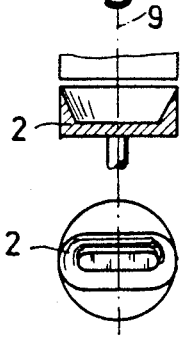

CENTRIFUGAL STIRRING APPARATUS

This application is a continuation of Application Ser. No. 757,357, filed July 22, 1985, now abanodned.

FIELD OF THE INVENTION

The invention relates to a centrifugal stirring apparatus for altering the shape, surface and/or size of loose particles or workpieces, comprising a work vessel and a rotatably driven stirring disc mounted on the floor of the work vessel for rotation about an axis of rotation and serving to circulate particles and workpieces in the work vessel.

BACKGROUND OF THE INVENTION

A stirring or agitating apparatus of this type is known, for example, from the German laid-open paper No. DE-OS 33 20 891. This apparatus is based on the principle of so-called "glide griding" which enables, in particular, the surface polishing of workpieces and the comminution, granulation or agglomeration of particles to be carried out. Typical for the process of glide grinding is the continuous circulation and mixing of a filling of loose particles or workpieces under primarily shearing forces, which make themselves conspicuous in a roller of the particles or workpieces being treated. Treating materials, such as polishing mediums or materials, may be added in particular for the glide grinding of workpieces. During the treatment of particles, their shape alters to become more spheroidal. the size of the particles is reduced during glide griding and comminution but generally increased during granulation or agglomeration.

A number of apparatuses are available for carrying out glide grinding methods, e.g. rotary tumblers, rotary bell-shaped receptacles, rotary discs, vibrators and stirring or agitating receptacles. More detailed information on these apparatuses and methods may be found in H.E. Hinz "Gleitschleifen" (=glide grinding), Expert publishing house, Grafenau 1980 and on granulation or agglomeraton in P. J. Charrington and R. Oliver "Granulation", Haeyden & Son, Rheine 1981.

Centrifugal stirring or agitating apparatuses are particularly favourable. They consist of a cylindrical vessel comprising a rotary stirring tool, usually in the form of a stirring disc on the vessel floor. The mass produced products to be treated undergo a toroidal movement in the vessel. This is characterized by the Froude number which is defined as the ratio of centrifugal acceleration to the acceleration due to gravity. It is within the range of between 10and 100. Furthermore, the specific volume capacity is very important for these methods. The values should be as high as possible, approximately 100 $kW/m^3$.

A disadvantage of all known centrifugal stirring apparatuses is the fact that they may be operated only in batches, have only a low specific volume capacity and are subject to high wear and tear in the case of stirring tools with convex profiles.

Operation in batches is understood to mean that the apparatus has to be filled with the loose material or mass produced products in a complicated and time-consuming manner, usually manually, before treatment can commence and emptied again once treatment is concluded. Continuous operation with, in particular, automatic feeding and discharge of the materials to be treated has not so far been possible.

SUMMARY OF THE INVENTION

The object of the invention is therefore to improve a centrifugal stirring apparatus of the type in question such that a continuous operation is possible, in particular without the stirring discs being stopped, and so that a high specific volume capacity may be guaranteed.

Accordingly, the present invention provides a centrifugal stirring apparatus which comprises two or more work vessels connected to one another by a common overflow opening between them. The cross-sectional surface of the opening is narrowed in relation to the height and diameter of the work vessels. The centrifugal stirring apparatus further comprises a mechanism for adjusting the cross-sectional surface of the overflow opening and a rotatably driven stirring disc mounted on the bottom of each work vessel. Upon rotating the stirring disc, the particles and work pieces circulate in the work vessels and the treated particles or workpieces are passed directly from one work vessel to another through the common overflow opening. The work vessels are arranged one behind the another in a continuous row, and the loose particles or workpieces may be introduced into the first work vessel of the row where they will travel continuously through all of the vessels of the row before being removed from the last vessel of the row.

The invention further provides a centrifugal stirring apparatus which comprises two or more work vessels including at least first and second generally cup-shaped work vessels directly connected to each other and having a common overflow opening between them. The ratio of the height of each work vessel to the diameter of each work vessel is in the range of about 1 to about 2 and the ratio of the width of the common overflow opening to the diameter of each work vessel is in the range from about 0.2 to about 0.6. The centrifugal stirring apparatus further comprises a rotatably driven stirring disc mounted on the floor of each work vessel and rotatable about an access of rotation. The ratio of the distance between the axes of rotation of the first and second vessel to the diameter of each work vessel is in the range of about 1.05 to about 1.2. When the stirring discs rotate, the work pieces circulate in the work vessels in a toroidal rolling movement, holding the loose work pieces in the individual work vessels for a certain length of time to enable treatment of the work pieces to be carried out. The work pieces to be treated may be introduced into the first work vessel and then passed directly from the first work vessel into the second work vessel through the common overflow opening.

In this way, the material to be treated may be fed in continuously or in batches and drawn off again continuously after passing through the apparatus which comprises a plurality of stirring discs. The quality and intensity of treatment may be controlled by altering the number of agitating stations, through which the material passes, by altering the rotational speed and direction of rotation of the stirring discs as well as by adjusting the cross-sectional area and level of the overflow openings accordingly. The time the material to be treated is required to remain in the treatment stations arranged adjacent one another may, in particular, be adjusted accordingly due to the arrangement of a plurality of work vessels next to one another, these work vessels all comprising stirring discs.

BRIEF DESCRIPTION OF THE DRAWING

The following description of preferred embodiments of the invention serves to explain the invention in greater detail in conjunction with the attached drawings, in which FIG. 1 shows a schematic side view of a centrifugal stirring apparatus comprising a plurality of treatment stations;

FIG. 2 is a plan view of the apparatus shown in FIG. 1;

FIG. 3 is a partial plan view similar to that in FIG. 2;

FIGS. 4 to 7 show various work surfaces for the stirring discs in cross section and in the plan view;

DESCRIPTION OF THE EXPEMPLARY EMBODIMENTS

Figure 8:
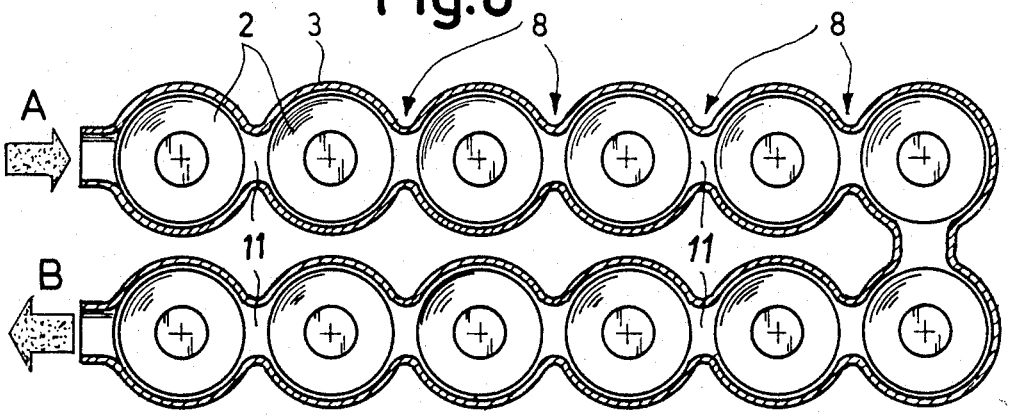
FIG. 8 shows a stirring apparatus comprising a total of 10 stations, the inlet and discharge openings hereby lying adjacent one another.

FIG. 1 shows a frame or supporting structure 1, on which a total of 5 stirring, dish-shaped discs 2 are rotatably mounted adjacent one another. Disposed around the stirring discs 2 are, for example, cup-shaped or cylindrical work vessels 3, which accommodate the particles or workpieces 4 in the form of a loose filling of material. The individual work vessels 3 are, as indicated schematically in FIG. 2, connected with one another by means of narrow passages or constrictions 8 in the form of overflow openings. The loose material to be treated is fed to the stirring apparatus at an inlet opening A in the first work vessel 3 and after completion of treatment is drawn off at a discharge opening B provided in the last work vessel. The material may be preferably drawn off in the direction of the dotted arrow B, i.e. in the same direction as the direction of flow of the loose material through the individual work vessels 3. A motor 5 drives the individual stirring discs 2 via a belt or chain 6. A device 7, e.g. a screw spindle, which is known per se enables the setting of the stirring apparatus to be altered relative to the horizontal so that the.direction of flow of the loose material over the individual stirring discs may be inclined slightly downwards, supported by the force of gravity.

The axes of rotation of the individual discs have the reference numeral 9. When passing through the individual work vessels 3 with their respective discs 2, the loose material remains in the individual work vessels for a certain length of time to enable treatment to be carried out and then passes through the overflow opening into the next vessel until it finally exits from the apparatus at the discharge opening B once treatment is complete.

FIG. 3 shows in detail a narrow passage 8 forming the overflow opening between two work vessels 3. The overflow opening has, at this point, a width b. The diameter of the work vessel is D, the distance between the axes of two stirring discs is a and the height of the work vessels 3 is designated H (FIG. 1). A favourable geometry for the practical construction of the stirring apparatus is then: $b/D = 0.2$ to 0.6, $H/D = 1$ to 2 and $a/D = 1.05$ to 1.2. The number of discs 2 may be between 5 and 15, ; preferably between 8 and 12. The drive for the stirring discs may be designed as a group drive by a single motor 5 or as individual drive means for each disc,from above or below,by means of a plurality of electric motors.

FIGS. 4 to 7 show various stirring discs, the work surfaces of which are not convex in the peripheral direction, i.e. are designed to be concave or hollow. The outer contours of these work surfaces are, as also shown in FIGS. 4 to 9, axially unsymmetrical in relation to the axis of rotation 9. The work surface of the disc 2 is, for example, designed as an unsymmetrical truncated cone in FIG. 4, an elliptic truncated cone in FIG. 5, a truncated pyramid in FIG. 6 and in the form of an arena in FIG. 7. Work surfaces which are axially symmetrical in relation to the axis of rotation 9 are, however, suitable as well. In FIG. 8, a total of 12 work vessels 3 comprising stirring discs 2 are arranged one behind the other, the loose material to be treated passing through the first five work vessels from left to right and the following work vessels from right to left since the overflow opening between the fifth and sixth work vessels is displaced through 90° in relation to the direction of flow. In this way, inlet opening A and discharge opening B are comfortably arranged next to one another and the arrangement as a whole saves on space.

Figure 9:
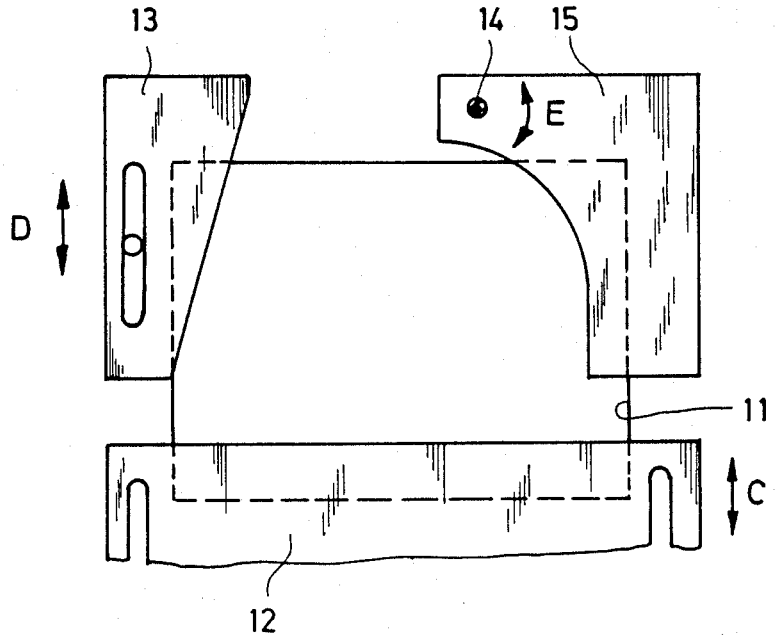
FIG. 9 shows an overflow opening comprising various shutters for altering the cross-sectional area of the opening.

Finally, FIG. 9 shows in schematic form an overflow opening 11 arranged at the narrow point between two adjacent work vessels 3. The lower edge of the opening 11, i.e. the position of the opening with regard to height in relation to the adjacent stirring disc, may be altered by a first shutter 12 which may be moved up and down in the directions shown by the double-headed arrow C. This can influence the flow behaviour of the loose material within the apparatus. The cross-sectional area of the overflow opening 11 may be altered by the shutter 13 which is movable in the directions shown by arrow D. The same may be achieved with the aid of a shutter 15 which is mounted at 14 for pivoting movement in the directions shown by arrow E. The time the loose material remains in the stirring apparatus may be adjusted in the desired way by altering the cross-sectional area of the opening accordingly.

In a particularly favourable embodiment of the invention it is possible for successive stirring discs 2 to rotate in opposing directions with or without a difference in rotational speed. This means that the loose material to be treated is evenly subjected to shearing forces when passing thourhg the work vessels 3.

In a further preferred embodiment, all or several of the discs 2 rotate in the same direction with or without a difference in rotational speed. For some mass produced products, it is expedient to subject them to temporary impingement forces. This is achieved by such an embodiment.

It is also advantageous for realization of the invention, as already mentioned, when the work surfaces of the stirring discs 2 are not convex in the peripheral direction and not designed as symmetrically rotational bodies in relation to the axis of rotation 9. This achieves a positive transfer of torque from the stirring disc to the filling of loose material without the necessity of convex parts which are subject to wear and tear.

In an additional advantageous embodiment of the invention the work vessels 3 are designed as a straight or annular channel (FIG. 8). This is a constructive solution which saves space and is favourable for a central drive. The channel common to all the discs 2 has a constricted overflow opening 11 between every two adjacent stirring discs. Constricted means, in this case, that the diameter of the overflow opening 11 is smaller than the diameter D of the work vessel and the height H. The constricted overflow openings between the individual work vessels enable the flow of loose material therethrough to be controlled such that the material flows forwards in the direction of flow substantially uniformly between the individual stirring discs and without any return flow. It is also possible to adjust the distribution of material exactly with regard to the tine spent in each work vessel.

The overflow opening 11 (FIG. 9) need not be limited by straight edges. The edges may also be curved so that the overflow opening is round or oval.

What is claimed is:

1. A centrifugal stirring apparatus for altering the shape, surface and/or size of loose particles or workpieces, the centrifugal stirring apparatus comprising a plurality of work vessels including at least two generally cylindrical work vessels connected to each other having a common overflow opening between them wherein each work vessel has a height, diameter and a bottom end, the opening has a crosssectional surface, and the cross-sectional surface of the opening is narrowed in relation to the height and diameter of the work vessels, means for adjusting the cross-sectional surface of the overflow opening, and a rotatably driven stirring disk mounted on said bottom end of each work vessel for rotation about an axis of rotation whereby the particles and workpieces circulate in the work vessels, and the treated particles or workpieces pass directly from one work vessel into another through the opening, the work vessels being arranged one behind the other in a continuous row and the loose particles or workpeices being introduced into the first work vessel of the row, travelling continuously through all the vessels of the row and being removed from the last vessel of the row.

2. The stirring apparatus of claim 1 wherein the plurality of work vessels includes at least one work vessel having means defining an inlet opening for the particles or workpieces and another work vessel having means defining a discharge opening for the particles or workpieces.

3. The stirring apparatus of claim 1 wherein the adjusting means comprises a shutter or the like.

4. The stirring apparatus of claim 1 further comprising means for adjusting the position of the overflow opening with regard to height in relation to the stirring disk.

5. The stirring apparatus of claim 2 further comprising means for adjusting the position of the overflow opening with regard to height in relation to the stirring disks.

6. The stirring apparatus of claim 1 wherein the plurality of work vessels are arranged one behind the other in a substantially straight row.

7. The stirring apparatus of claim 2 wherein the plurality of work vessels are arranged one behind the other in a substantially straight row.

8. The stirring apparatus of claim 2 wherein the plurality of work vessels are arranged one next to another in a compact configuration such that the first work vessel is substantially located adjacent to the last work vessel.

9. The stirring apparatus of claim 1 wherein the stirring disks rotate at least partially in opposing directions.

10. The stirring apparatus of claim 1 wherein the stirring disks rotate at least partially at varying rotational speeds.

11. The stirring apparatus of claim 1 wherein each stirring disk has a work surface, said work surface being concave in the peripheral direction.

12. The stirring apparatus of claim 1 wherein each stirring disk has a work surface, said work surface being rotationally unsymmetrical in relation to the axis of rotation.

13. The stirring apparatus of claim 1 wherein the plurality of work vessels comprise a channel common to all stirring disks, said channel comprising a constricted overflow opening between adjacent stirring disks.

14. The stirring apparatus of claim 1 further comprising a support frame for supporting the work vessels and means for adjusting the inclination of the support frame with respect to the horizontal.

15. The centrifugal stirring apparatus of claim 1 wherein the common overflow opening extends between the two workpieces in a direction generally perpendicular to the axes of rotation of the stirring disks.

16. A centrifugal stirring apparatus for altering the shape, surface and/or size of particles or workpieces in a loose filling of the workpieces and, in particular, for the surface polishing of workpieces by glide grinding, the centrifugal stirring apparatus comprising a plurality of work vessels including at least first and second generally cup-shaped work vessels directly connected to each other and having a common overflow opening between them wherein each vessel has a floor, a height H, and a diameter D, the ratio H/D being in the range from about 1 to about 2, and the opening has a width b and a cross-sectional surface, the ratio b/D being in the range from about 0.2 to about 0.6, and a rotatably-driven stirring disk mounted on the floor of each work vessel for rotation about an axis of rotation wherein the axis of the stirring disks of the first and second work vessels are spaced by a distance a, the ratio a/D being in the range from about 1.05 to about 1.2, whereby the workpieces circulate in the work vessels in a toroidal rolling movement holding the loose workpieces in the individual work vessels for a certain length of time to enable treatment of the workpieces to be carried out and whereby the workpieces to be treated are introduced into the first work vessel and pass directly from the first work vessel into the second work vessel through the opening.

* * * * *